United States Patent [19]

Colombo

[11] 4,290,479

[45] Sep. 22, 1981

[54] DRAWING AND STRAIGHTENING MACHINE FOR USE IN CONTINUOUS CASTING PLANTS

[76] Inventor: Piero Colombo, 21, Via G. Ferraris, Udine, Italy

[21] Appl. No.: 107,505

[22] Filed: Dec. 27, 1979

[30] Foreign Application Priority Data

Dec. 28, 1978 [IT] Italy ..... 12916 A/78

[51] Int. Cl.[3] ..... B22D 11/08; B22D 11/128

[52] U.S. Cl. ..... 164/448; 164/446

[58] Field of Search ..... 164/426, 442, 446, 448

[56] References Cited

U.S. PATENT DOCUMENTS

| | | | |
|---|---|---|---|
| 3,290,741 | 12/1966 | Olsson | 164/82 |
| 3,344,844 | 10/1967 | Reinfeld et al. | 164/426 |
| 3,426,835 | 2/1969 | Michelson | 164/426 |
| 3,702,154 | 11/1972 | Rokop et al. | 164/426 X |
| 3,930,533 | 1/1976 | Rokop et al. | 164/426 |

FOREIGN PATENT DOCUMENTS

| | | | |
|---|---|---|---|
| 1458216 | 1/1969 | Fed. Rep. of Germany | 164/426 |

*Primary Examiner*—Robert D. Baldwin

*Attorney, Agent, or Firm*—Lowe, King, Price & Becker

[57] ABSTRACT

The drawing and straightening machine for use in continuous casting plants, comprises a first pair of superposed pinch rolls, arranged at the bottom end of the curved guide path section, passing through which the casting is bent, and a second pair of pinch rollers arranged subsequently to the first pair. The second pair of pinch rollers is mounted on the machine frame so as to be capable of swinging from an upper starting position, at which the rolls are operatively arranged on the curvilinear upwardly directed prosecution of the curved path of the casting, to a lower straightening position, at which the rolls are in alignment with the rectilinear guide section onto which the straightened casting moves for further processing. Each roll of the second pair of rolls is mounted on a roll-carrier, and each roll-carrier is hinged to the machine frame around a single common fulcrum axis. A first piston and cylinder assembly is provided for assuring a constant pinch pressure of the rolls of the second pair, and a second piston and cylinder assembly is provided for the movement of the two roll-carriers either to the upper starting or to the lower straightening position.

3 Claims, 2 Drawing Figures

DRAWING AND STRAIGHTENING MACHINE FOR USE IN CONTINUOUS CASTING PLANTS

SUMMARY OF THE INVENTION

The present invention relates to a drawing and straightening machine for use in continuous casting plants presenting a curved guide path for bending the casting, which leaves the casting mold, from a substantially vertical direction to a rectilinear, substantially horizontal direction. The drawing and straightening machine according to the invention is arranged at the bottom end of the curved guide path section where the casting needs precisely to be drawn at a predetermined required speed and striaghtened, in order to proceed horizontally for further processing. Usually, at the bottom end of the curved guide path, there are provided, at the point of separation or transition between the curved section and the rectilinear (horizontal) section, a pair of superposed pinch rolls, which draw the casting at the predetermined required speed. After the said pair of pinch rolls, there are provided so-called straightening rolls, which serve for straightening the casting, which otherwise would have the tendency of prosectuing its movement along a curved path directed upwardly.

The machine according to the invention comprises a first pair of pinch rolls, arranged in correspondence of the point of separation or transition between the bottom end of the curved path section and the beginning of the rectilinear horizontal section, and a second pair of pinch rolls, which have primarily the function of straightening rolls, arranged subsequently to the said first pair of pinch rolls, and which are alternatively movable jointly along a substantially vertical path, from an upper starting position at which they are in alignment with the upwardly directed curvilinear prosecution of the curved path of the continuous casting, to a lower straightening position, at which they are aligned with the rectilinear guide section onto which the casting moves after having been straightened, for further processing.

The said second pair of pinch rolls comprises a pair of superposed rolls, at least one of which is positively driven into rotation, and means, usually in the form of a piston and cylinder assembly, for assuring a correct constant pinch pressure of the two rolls. The said pinch pressure between the two rolls is maintained constant also during the vertical movement of the two rolls, in order to ensure a perfect and constant drawing of the continuous casting which is subjected to the straightening operation.

In the operation of the machine, the said second pair of pinch rolls is maintained in its upper position until the so-called starting bar has been completely passed through the said pair, and removed from above. At this point, when the metal casting has been gripped between the pinch rolls and it is positively drawn, the said second pair of rolls is lowered to its lower position, thus effecting the proper straightening of the bar, while maintaining the correct pinch pressure required for the drawing.

The drawing and straightening machine according to the invention presents further more reduced overall dimensions with respect to the known machines, which enables a consequent reduction of the dimension of the continuous casting plant in which it is inserted.

BRIEF DESCRIPTION OF THE DRAWINGS

The above and other features and advantages of the machine according to the invention will appear evident from the following detailed description of a preferred embodiment of same, made with reference to the attached sheet of drawings, in which.

DESCRIPTION OF THE PREFERRED EMBODIMENT

Figure 1:
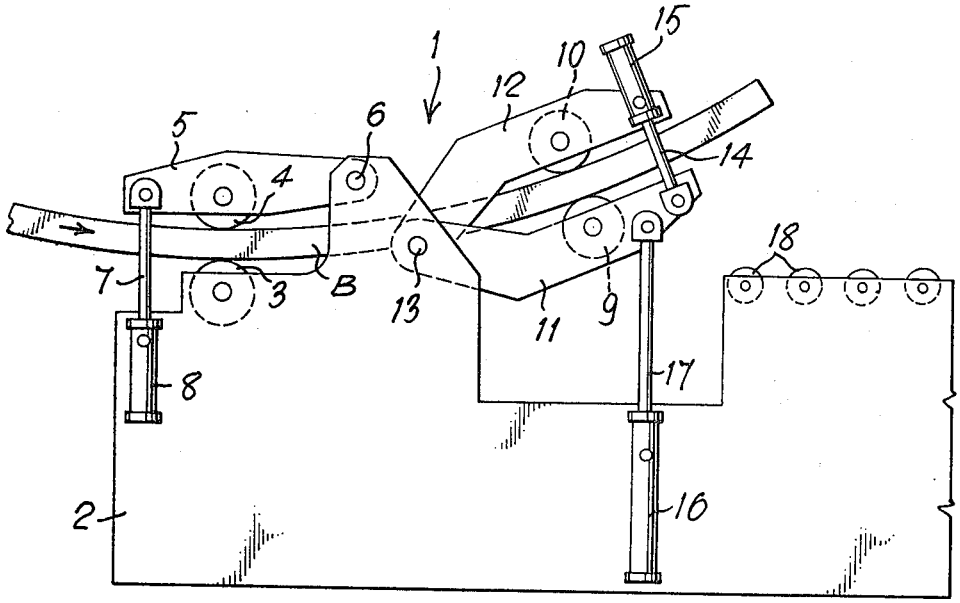
FIG. 1 is a diagrammatic side elevation view of the drawing and straightening machine according to the invention, with the second pair of pinch rolls in upwardly swung position.

The drawing and straightening machine 1, which is arranged in correspondence of the bottom or outlet end of the curved guide path section of a continuous casting plant, consists substantially of two consecutive pairs of pinch rolls 3, 4 and 9, 10.

The first pair of pinch rolls 3,4 (by having in mind the direction of movement of the continuous casting B) is arranged at the point of separation or transition between the end of the curved guide path section and the rectilinear guide section (which rectilinear guide section is usually horizontal). The said first pair of pinch rolls comprises a lower roll 3 rotatably mounted on the machine frame 2, and an overlying upper roll 4 rotatably mounted on a roll-carrier 5. The roll-carrier 5 is mounted on the machine frame 2 so as to be capable of swinging around the fulcrum axis 6, which is arranged trasversally with respect to the direction of movement of the casting B. The pinch pressure of the rolls 3, 4 of the first pair of pinch rolls is obtained by means of at least one piston and cylinder assembly 7, 8. In the illustrated embodiment, the piston rod 7 is hinged to the swinging roll-carrier 5, while the cylinder 8 is hinged to the machine frame 2. At least one of the two rolls 3, 4 is positively driven into rotation in a known manner.

The second pair of pinch rolls 9, 10, i.e. the pair of pinch rolls arranged subsequently after the first pair, downstream with respect to the said pair (having in mind the direction of movement of the continuous casting B), is arranged immediately after the first pair of rolls 3, 4, in the rectilinear zone of the path of the casting. The said second pair of pinch rolls comprises two superposed rolls 9, 10 of which at least one is positively driven into rotation in a known manner. The said second pair of pinch rolls 9, 10 is mounted on the machine frame 2 so as to be capable to oscillate as a single unit in the vertical direction. In the illustrated embodiment, each roll 9, 10 is mounted on a roll-carrier 11 respectively 12 and each roll-carrier is capable of swinging around a common fulcrum axis 13 located between the first pair of pinch rolls 3, 4 and the second pair of pinch rolls 9, 10, transversely directed with respect to the direction of movement of the casting B.

The pinch pressure of the pinch rolls 9, 10 of the second roll pair is obtained by means of a piston and cylinder assembly 14, 15 which connects the two roll-carriers 11 and 12, while the common (joint) oscillation of the superposed roll-carriers 11 and 12 of the second pair of pinch rolls 9, 10 takes place around the fulcrum axis 13 under the action of at least one piston and cylinder assembly 16, 17, in which the piston rod 17 is hinged to the lower roll-carrier 11, while the cylinder 16 is hinged to the machine frame 2.

Figure 2:
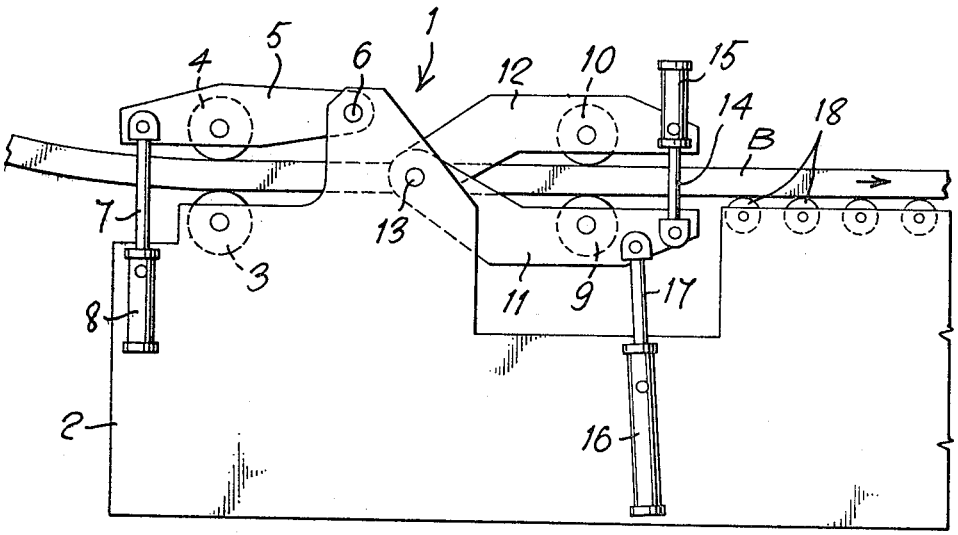
FIG. 2 is a side elevation view similar to that of FIG. 1, with the second pair of pinch rolls in downwardly swung, straightening posiiton.

In this manner, the unit consisting of the two superposed roll-carriers 11 and 12 is capable of swinging around the common axis 13 so as to bring the second pair of pinch rolls 9, 10 either to an upwardly swung position (as illustrated in FIG. 1) to a downwardly swung position (as illustrated in FIG. 2) and it can be secured in either position. In the upwardly swung or "starting" position shown in FIG. 1, the second pair of pinch rolls 9, 10 lies on the prosecution of the upwardly directed curved path or the continuous casting B. In this upwardly directed position the so-called starting bar of the continuous casting is drawn through the drawing and straightening machine 1 and removed from above from the path of the casting. Finally, when the continuous casting B (after separation from the starting bar) comes to move through the second roll pair 9, 10, the said pair of pinch rolls 9, 10 is swung down to the straightening position shown in FIG. 2, at which position it lies aligned with the rectilinear path of the casting B, as defined by the roller guide 18.

As it appears evident, the oscillation of the second pair of pinch rolls 9, 10, effected through the corresponding oscillation of the roll-carriers 11, 12, does not at all influence the pinch pressure of the said two rolls 9, 10, which is determined by the piston and cylinder unit 14, 15, and therefore does not influence the drawing action (pull) exerted by the said pinch rolls on the starting bar and on the continuous casting B.

It is believed that the invention will have been clearly understood from the foregoing detailed description of the preferred embodiment. Changes in the details of construction may be resorted to without departing from the spirit of the invention, and it is accordingly intended that no limitation be implied and that the hereto annexed claims be given the broadest interpretation to which the employed language fairly admits.

I claim:

1. A drawing and straightening machine for use in continuous casting plants presenting a curved guide path for bending the casting leaving the casting mold, from a substantially vertical direction to a rectilinear direction different from the vertical comprising:

(a) a first pair of pinch rolls arranged at a point of separation between the lower end of a curved guide path section and a rectilinear guide section, at least one of the rolls of said first pair being positively driven into rotation;

(b) a second pair of pinch rolls, arranged subsequently to said first pair of pinch rolls, in the direction of movement of the continuous casting, and in the zone of the rectilinear guide section, said second pair of pinch rolls being mounted on a pair of roll carrier frames, said pair of roll carrier frames being pivotally secured to a machine frame having a pivot axis located between said first and second pairs of pinch rolls, and means for pivotally moving said pair of roll carrier frames and said second pair of pinch rolls in a substantially vertical direction to a lower straightening position for alignment with said rectilinear guide section, and to an upper starting position wherein said second pair of pinch rolls lies substantially on an upwardly directed portion of the curved path of the continuous casting; and (c) means interconnecting each of said roll carrier frames for adjusting the pinch pressure between the second pair of rolls in a manner independent of the vertical positioning of said second pair.

2. A drawing and straightening machine according to claim 1, wherein said means for pivotally moving said roll carrier frames and said second pair of pinch rolls in a substantially vertical direction includes a piston and cylinder assembly.

3. A drawing and straightening machine according to claim 1 or 2, wherein said means interconnecting each of said roll carrier frames includes a piston and cylinder assembly.

* * * * *